United States Patent [19]

Wise et al.

[11] Patent Number: 4,637,096

[45] Date of Patent: Jan. 20, 1987

[54] METHOD AND APPARATUS FOR CLEANING COTTON

[75] Inventors: Dan S. Wise, Kings Mountain; George A. Miller, Dallas, both of N.C.

[73] Assignee: Wise Industries, Inc., Kings Mountain, N.C.

[21] Appl. No.: 789,146

[22] Filed: Oct. 18, 1985

[51] Int. Cl.[4] ..... D01G 1/00

[52] U.S. Cl. ..... 19/200; 19/205

[58] Field of Search ..... 19/200, 202, 204, 205

[56] References Cited

U.S. PATENT DOCUMENTS

| | | | |
|---|---|---|---|
| 3,149,065 | 9/1964 | Van Doorn | 19/205 X |
| 4,040,948 | 8/1977 | Hergeth et al. | 19/200 X |
| 4,229,286 | 10/1980 | Bridges | 19/200 X |
| 4,365,389 | 12/1982 | Beneke et al. | 19/200 |
| 4,519,114 | 5/1985 | Rhyne | 19/205 X |

FOREIGN PATENT DOCUMENTS

| | | | |
|---|---|---|---|
| 2426742 | 12/1975 | Fed. Rep. of Germany | 19/200 |
| 0810856 | 3/1979 | U.S.S.R. | 19/200 |

*Primary Examiner*—Louis K. Rimrodt

*Attorney, Agent, or Firm*—Julian W. Dority

[57] ABSTRACT

A method and apparatus for cleaning cotton is disclosed wherein an air stream bearing cotton is introduced into an inlet chamber having side-by-side outlet ducts covered with a screen that collects cotton yet lets trash pass therethrough. The air stream is alternately diverted from one outlet duct to the other so that while cotton is accumulating on the screen in front of one duct, it is being removed from the other. The cotton, as it is removed from the screen, falls onto an inclined shaker screen which vibrates additional dirt from the cotton before it is discharged from the apparatus.

10 Claims, 4 Drawing Figures

METHOD AND APPARATUS FOR CLEANING COTTON

FIELD OF THE INVENTION

This invention relates to a method and apparatus for cleaning cotton or similar textile raw material or fibrous products. In particular, the invention relates to cleaning a raw textile product which can be transported by an air stream and in which the raw textile product has trash and dirt intermingled with the fibers.

BACKGROUND OF THE INVENTION

To remove trash and dirt from raw cotton many pneumatic systems have been devised in the past. One example of a relatively early system is shown in U.S. Pat. No. 1,265,908 which issued on May 14, 1918 to J. L. Hart. In this patent is described a pneumatic elevator and distributor for cotton gins wherein airborne cotton is first projected against a separator screen to remove dirt and then is moved through toothed rollers which cooperate to thoroughly clean the cotton, thoroughly separating the fibers, and tearing the matted cotton into a loose flocculent mass and the foreign matter, dirt and the like is discharged. The clean cotton is then distributed to any one of a series of gins.

Another pneumatic system of cleaning cotton is disclosed in U.S. Pat. No. 2,009,928 which issued on July 30, 1935, to N. B. Henry. In this patent, the cleaning is effected by directing the airborne cotton to cleaning rolls or by separation early by the air current that carries loose dirt away. This allows the operator to clean the cotton at will and avoid overcleaning or damage to green or damp cotton or long staple cotton.

In U.S. Pat. No. 3,163,472 which issued on Dec. 29, 1964, to A. Zeismar a pneumatic cotton cleaner is shown in which a series of deflectors and hanging rods are placed in the stream of air bearing cotton and as the cotton strikes the rods and deflectors, dirt and trash are dislodged and travel with the stream of air while the cotton falls to a collection bin.

U.S. Pat. No. 3,486,309 which issued on Dec. 30, 1969, to James Aubrey Wild shows an apparatus for pneumatically conveying bulk fiber waste from a plurality of textile machines, separating the fiber waste from the air by means of a filter separator unit and providing for momentarily reversing the air flow through the filter to clean the filters.

Still another apparatus using an air stream to collect textile fibers is described in U.S. Pat. No. 4,154,485 which issued on May 15, 1979, to K. G. Lytton et al and which discloses the use of an air stream bearing fibers to collect fibers on an isolating plate to form a web.

There is also a prior art fiber cleaning machine that directs a fiber laden stream of air onto a perforated screen by means of vertically extending plates that sweeps back and forth in front of the screen. The fibers strike and screen and drop down into a receiver while some of the trash contained in the fibers passes through the perforated screen for being separated from the fibers.

A general object of the present invention is to provide a method and apparatus which is an improvement over the above described prior art methods and apparatus for cleaning cotton.

Another object of the present invention is to provide a method and apparatus for cleaning cotton in which little or no damage is inflicted upon the cotton being cleaned.

Still another object of the present invention is to provide a method and apparatus in which the cotton undergoes a number of separating effects in a relatively uncomplicated series of steps.

Many other objects and advantages will become clear from the reading of the following description of the invention.

SUMMARY OF THE INVENTION

The foregoing objects are unexpectedly and surprisingly achieved by the present invention which, in one aspect, is a method of cleaning cotton or the like comprising: drawing an air stream bearing cotton through a first portion of an air pervious member whereby the cotton collects on the upstream side of the first portion of the member and dirt passes therethrough; diverting the air stream bearing cotton from the first portion through a second portion of the air pervious member thereby collecting cotton on the upstream side of a second portion while dirt passes therethrough; and removing the cotton from the upstream side of the first portion while the air stream is diverted through the second portion. In another aspect, the present invention provides an apparatus for carrying out the aforementioned method.

In still another aspect, the method includes collecting the cotton as it falls from the air pervious member on to an inclined shaker screen and vibrating the cotton to further remove trash as the cotton tumbles down the screen.

In still another aspect, the present invention is a method and apparatus for cleaning cotton wherein an air stream bearing cotton is introduced into an inlet chamber having side-by-side outlet ducts covered with a screen that collects cotton yet lets trash pass therethrough. The air stream is alternately diverted from one outlet duct to the other so that while cotton is accumulating on the screen in front of one duct, cotton is being removed from the screen in front of the other. The cotton removed from one duct is collected on a shaker screen which vibrates to further remove trash and dirt from the cotton and to move it to a rotary valve which discharges cleaned cotton into an outlet conduit.

The invention also resides in certain novel features and construction, combination and arrangement of parts, and in modes of operation, all of which will be readily understood and appreciated by those skilled in the art upon reference to the accompanying drawings and in connection with the detailed description following.

DESCRIPTION OF THE DRAWINGS

It is to be understood that the drawings illustrate what is regarded as a preferred form of the invention. Obviously, however, the invention is susceptible of other mechanical expressions within the spirit and scope of the subject matter claimed hereinafter.

In the drawings, which are appended to this specification and made a part hereof.

DESCRIPTION OF A PREFERRED EMBODIMENT

Figure 1:
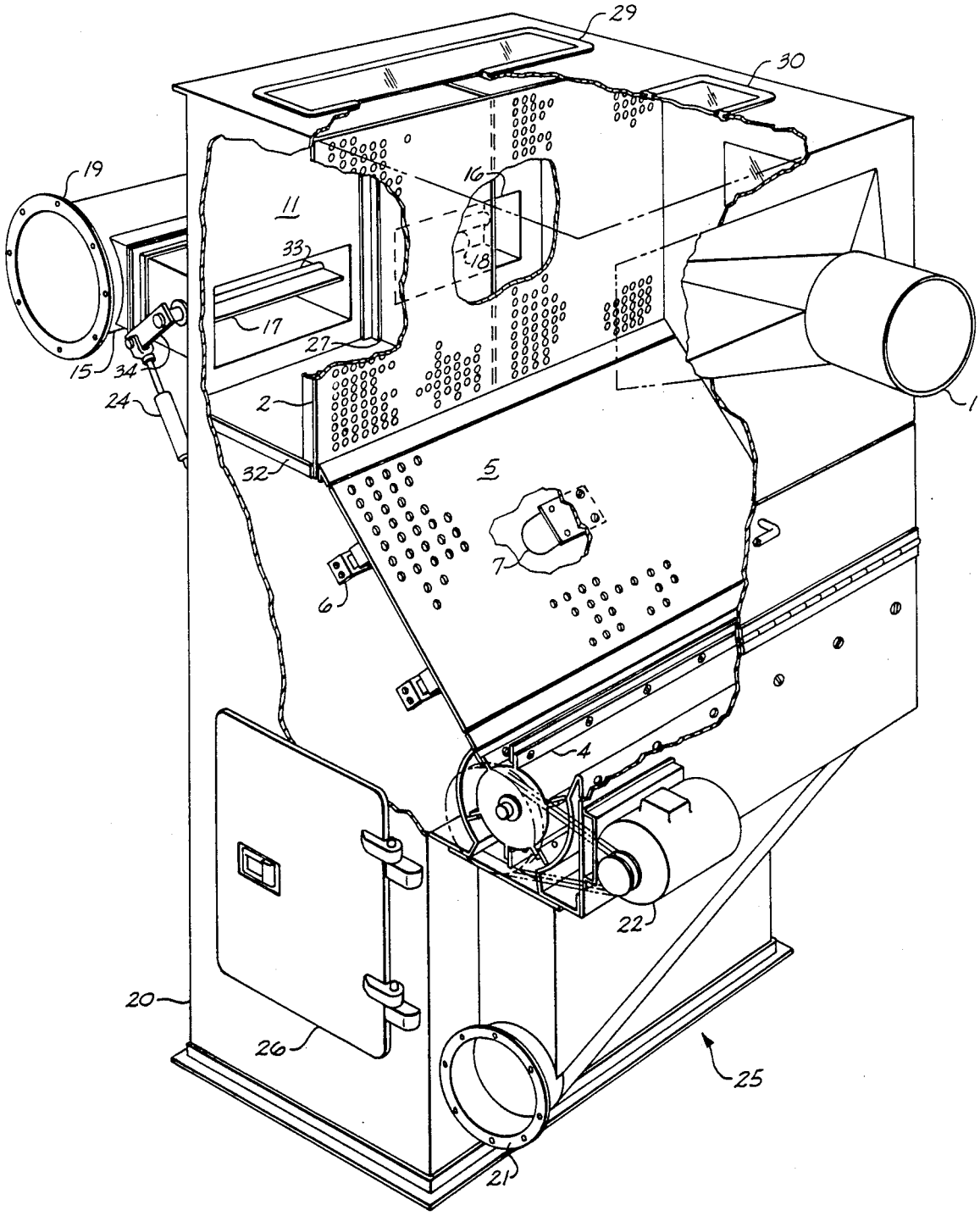
FIG. 1 is a perspective view of a preferred embodiment of the cotton cleaner of the present invention with a portion of the housing of the cotton cleaner cut away so that the interior arrangement of parts may be seen.

Referring first to FIG. 1, a preferred embodiment of the apparatus of the present invention is shown as cotton cleaner 25. Housing 20 is divided into chambers each with a specific purpose as will be described in more detail hereinafter. The arrangement of the external connections can be seen in FIG. 1. There is shown an inlet duct 1 through which an airborne stream of cotton is introduced into the cotton cleaner, a discharge conduit or pipe 21 from which the cotton which has been cleaned leaves the cotton cleaner, a trash removal door 26, an airborne trash removal manifold 19, and access hatches 29 and 30.

Figure 2:
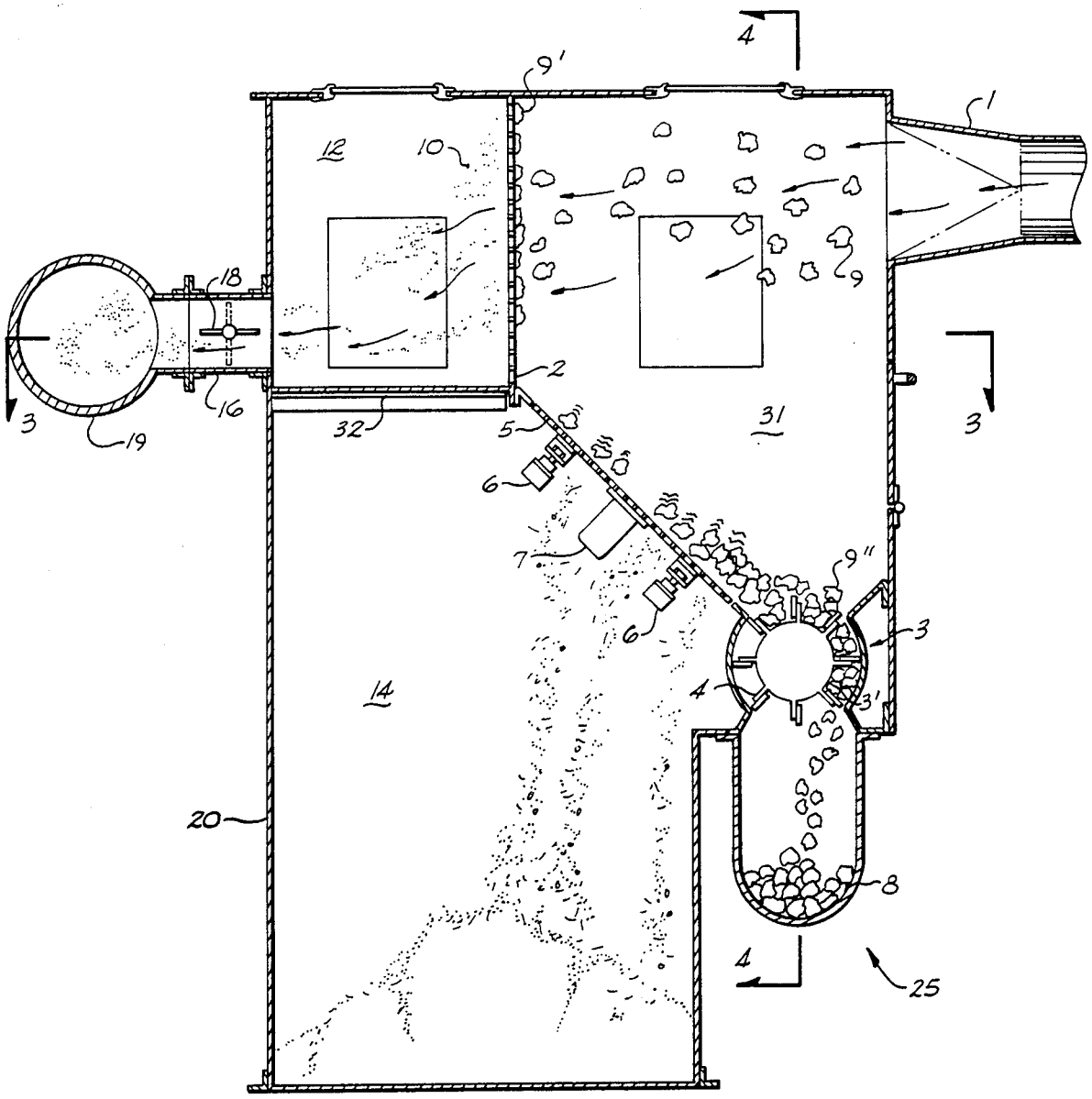
FIG. 2 is an elevational side view of a section through approximately the mid plane of the embodiment of FIG. 1, the view being along lines 2—2 of FIG. 3.
Figure 3:
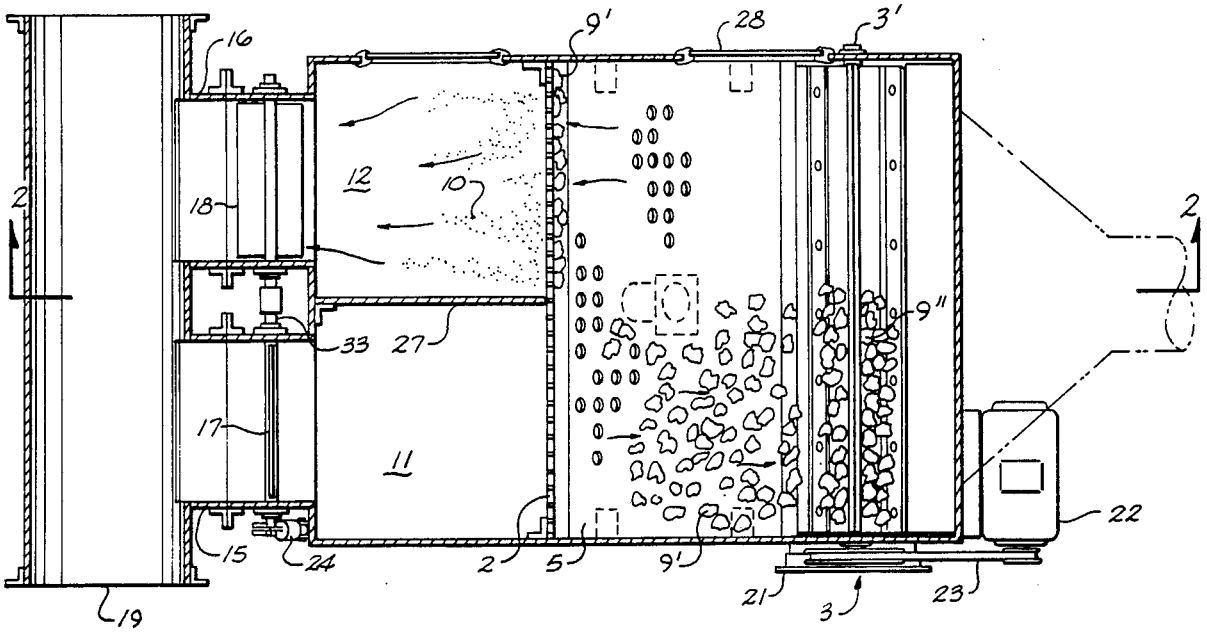
FIG. 3 is a top plan view of the section looking downwardly from lines 3—3 of FIG. 2.

FIG. 2 shows a side elevation view in section of the cotton cleaner 25, the view being approximately through the mid plane corresponding to a view in the direction of lines 2—2 in FIG. 3. The inlet duct 1 leads into inlet chamber 31 which is generally bound by the housing and shaker screen 5 and air pervious member 2 or collection screen for the outlet ducts. Screen 2, floor 32, and the adjacent part of housing 20 define the right trash removal duct 12 which is shown in FIG. 2. Below the trash removal duct 12 is trash collection chamber 14 which is bounded by the floor 32 of the trash removal duct, by the housing 20, and by the shaker screen 5. Exit duct 16 provides the outlet from trash removal duct 12 and the exit duct 16 feeds into the trash removal manifold 19. The right damper 18 or butterfly valve for the outlet from the trash removal duct is shown in this view in an open position. On the opposite side of the cotton cleaner 25 from the trash removal duct 19 is the rotary valve 3 having axle 3' about which is spaced vanes 4. Collection chamber 8 receives the cotton which has been cleaned.

FIG. 3, which is a top plan view of a section looking along the lines of 3—3 of FIG. 2 shows the side-by-side arrangement of the two trash removal ducts 11 and 12. These ducts have as a common front wall the screen or air pervious member 2 with wall 27 separating the two ducts and dividing them into different chambers. Each duct 11 and 12 has its respective outlets which are defined as exit ducts 15 and 16 and each of these ducts are provided with their respective dampers 17 and 18 which are on a common axle 33. The two exit ducts 15 and 16 feed into trash collection manifold 19 which removes airborne trash. Valve drive motor 22, drive belt 23, and the mouth to discharge conduit 21 are also shown in FIG. 3 along with inlet chamber access door 28.

Figure 4:
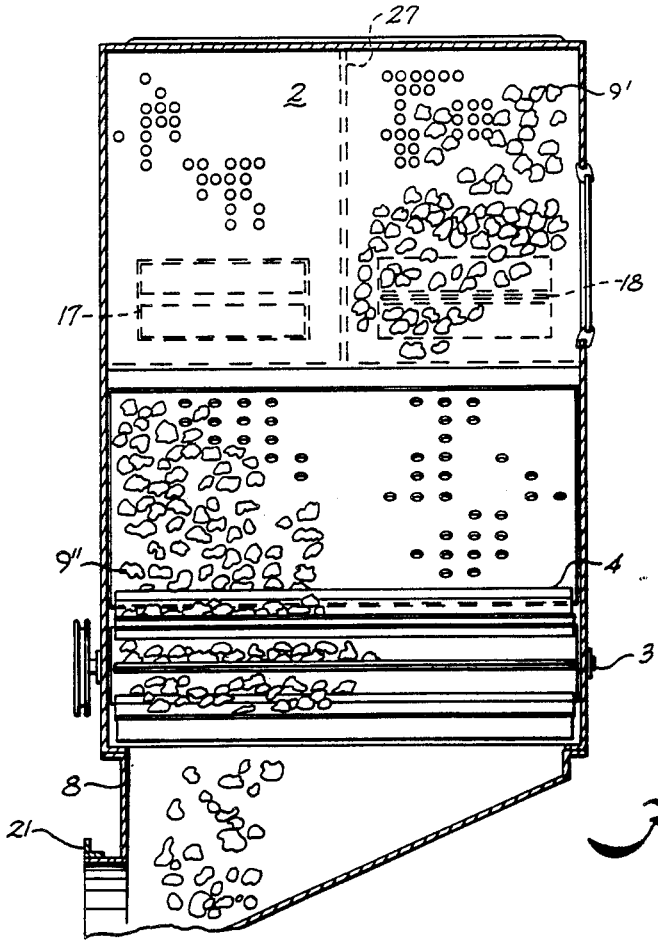
FIG. 4. is a front elevation view of the section looking in the direction of lines 4—4 of FIG. 2.

Looking now at FIG. 4, which is a front elevation in partial section looking in the direction of lines 4—4 of FIG. 2, the side-by-side positioning of the two trash removal ducts which have a common front screen or air pervious member 2 is seen with the divider wall 27 between the two ducts.

Returning now to FIG. 2 for a description of the operation of the cotton cleaner, an airborne stream bearing cotton is represented by the arrows and cotton balls 9 which emerge from inlet duct 1. As the only outlet for the air that is entering the housing is through exit duct 16 the cotton balls strike collection screen 2 and are collected there as can be better appreciated by viewing FIG. 3. The cotton 9' which is accumulated on the screen 2 is so designated to indicate that it is partially cleaned cotton. This cotton 9' is partially cleaned in that as it has traversed the inlet chamber 31 and has struck the screen 32, the cotton 9 obviously stops but the momentum of the trash 10 contained within the cotton 9 carries the trash and dirt particles that are loosened at this point through the screen into and across the trash removal duct 12 to the exit duct 16. At this point in time, the outlet to trash removal duct 11 is closed as the damper 17 is in its vertical position closing the duct 15. The effect of closing duct 15 is to remove the suction which had kept cotton 9' collected on the first portion on the screen 2 which is in front of the trash removal duct 11. This cotton which has fallen by gravity is shown as cotton 9" tumbling down the inclined shaker screen 5 towards the rotary removal valve 3. The tumbling action can be seen in detail in FIG. 2. Returning to FIG. 3, the accumulation of cotton on a first portion of the screen 2 and its removal from the second portion can be readily appreciated. FIG. 4 also shows the accumulation of the cotton 9' in front of the right hand trash removal duct 12 and shows the left hand damper 17 in a closed position and the right hand damper 18 in an open position so that there is suction to collect the cotton 9' on the right hand portion of the screen.

Returning now to FIG. 2, as suction is removed and applied alternately to the left and then to the right hand portions of the screen, cotton in a continuous manner falls alternately onto the left side of the shaker screen 5 and then on the right side. Shaker screen 5 is mounted on rubber mounts 6 so that it can be shaken and vibrated by a vibrator 7. The vibration has two functions, one is to move the cotton down the inclined screen 5 so that it will not bunch up and the other is to vibrate the cotton balls somewhat to further shake any dirt out of the cotton. Dirt by this stage has become loosened and dirt 13 is accumulated in trash collection chamber 14 as it passes through the perforations in screen 5. As the cotton moves on down the screen it is picked up by the vanes 4 of rotary valve 3 and is now cleaned cotton 9" as it moves into the valve 3. The vanes 4 keep the chamber 31 completely sealed as the cotton is moved around the axle 3' and deposited in the cotton accumulator 8. The rotary valve 3 acts much in the same manner as a revolving door in removing the cotton. It is important that the chamber 31 remain relatively airtight so that none of the air stream force is lost and all the air stream is concentrated on the screen where the cotton is being collected. One purpose of this is to bring into play still another means of removing the trash. As the cotton 9' is collected on the screen 2, the strong force of the air stream which is now concentrated to go out the exit duct will suck additional dirt out of the cotton while it is collected on the screen somewhat in the manner that a vacuum cleaner operates.

Looking now at FIG. 1, the means for alternating the air flow from one trash removal duct 11 to the other duct 12 will be described. On shaft 33 both dampers 17 and 18 are mounted, one being at right angles to the other, so that when the shaft is rotated, one damper will be closed and the other opened. Pneumatic cylinder 24 with crank arm 34 will rotate the shaft 33 a quarter turn when the piston of the cylinder 24 is on its outward stroke to put the damper 17 in its open position and to put damper 18 in its closed position as shown. When the piston is retracted on its inward stroke, the crank arm 34 will rotate the shaft back one quarter of a turn and this will close damper 17 and open damper 18.

Two methods of actuating the stroke can be used. One method is where the opening and closing is set on a time basis so that each damper is opened and closed a given number of times each minute. Control systems of this type to open and close a valve on the air line to cylinder 24 are well known in the art and are not further described herein.

Another control method is to locate pressure sensors in either the ducts 11 and 12 or in the exit ducts 15 and 16. When cotton has accumulated on the respective portion of the screen 2 in front of the duct sufficiently to block air flow, the pressure will change, increase, within the respective duct and this will be sensed and a signal sent to the cylinder 24 to close that duct and open the other. Such sensors and signal controls are also well known in the art and are not further described herein.

Additional trash removal ducts in the nature of ducts 11 and 12 with their respective valving and outlets could be added and might be advantageous under certain conditions. However, the side-by-side arrangement of two ducts to which the suction is applied alternately while cotton accumulates on one and is removed from the other is quite satisfactory and provides a reliable method by which to operate the cotton cleaning apparatus.

As can be seen from the foregoing, the method and apparatus of the present invention utilizes three distinct trash removal effects: One is the momentum effect as the cotton initially strikes the collector screen 2 and the cotton stops while the momentum of the trash carries it on through the screen. The second removal effect is that while the cotton is held on the screen, dirt and debris is literally sucked out of the cotton. And, the third effect is when the suction is removed from the cotton and it falls onto the shaker screen 5, the vibration of the screen shakes additional dirt and debris from the cotton. The result is cleaned cotton which has not been pulled apart or unnecessarily separated at this stage of processing and gives a product which is ready for further processing as the manufacturer may wish.

It will be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit and scope of the invention herein disclosed.

We claim:

1. A method of cleaning cotton or the like comprising:

(a) directing an air stream bearing cotton into a chamber;

(b) drawing said air stream and dirt in said cotton through only a first portion of an air pervious member imposed within the chamber;

(c) collecting the cotton on the upstream side of the first portion of said air pervious member;

(d) drawing said air stream and dirt within the cotton through only a second portion of said air pervious member and at the same time ceasing to draw the air stream through said first portion of said member; and (e) collecting the cotton on the upstream side of said second portion of said air pervious member and at the same time, removing the cotton from said first portion of said air pervious member.

2. The method of claim 1 wherein said air pervious member is vertical and the cotton is removed from the upstream side of the first portion by falling therefrom due to gravity when the air stream is drawn through said second portion of said air pervious member.

3. The method of claim 2 including the step of collecting the cotton as it falls on an inclined shaker screen, and shaking the cotton to further remove trash therefrom as the cotton tumbles down the screen.

4. The method of claim 1 including the further steps of:

(i) after the cotton is removed from the upstream side of the first portion, drawing the stream again through the first portion; and (ii) removing the cotton from the upstream side of the second portion.

5. A cotton cleaner comprising:

(a) a vertical, air pervious member;

(b) means for directing an air stream bearing cotton through said member whereby cotton is collected on the upstream side of said member while dirt and trash pass therethrough;

(c) means for drawing the air stream alternately through first and second portions of the air pervious member so that when the collected cotton covers the first portion, the air stream is drawn through the second portion allowing the cleaned cotton to fall from the first portion of the screen.

6. The cotton cleaner of claim 5 including an inclined shaker screen means to receive the cotton as it falls from the air pervious member.

7. The cotton cleaner of claim 6 including rotary valve means to collect and remove cotton that has tumbled down the inclined shaker screen means.

8. A cotton cleaner comprising:

(a) an enclosed housing, the interior of said housing being divided into four chambers comprising:

(1) a relatively large trash collection chamber;

(2) a relatively large cotton inlet chamber, said inlet chamber being located generally above said trash collection chamber; and (3) first and second trash removal ducts; said trash removal ducts being located near the top of the housing and to one side of the inlet chamber; and (b) a vertical air pervious member comprising a collection screen, said collection screen separating the first and second trash removal ducts from the inlet chamber;

(c) an inclined shaker screen located below the collection screen and separating the inlet chamber from the trash collecting chamber;

(d) vibrator means to vibrate the shaker screen to tumble cotton along its surface and to cause additional trash to be shaken from the cotton;

(e) an inlet duct into the inlet chamber for introducing an air stream bearing cotton into the inlet chamber;

(f) first and second outlets in the housing, said outlets being associated with the respective removal ducts;

(g) first and second damper means for alternately opening and closing the respective outlets, the alternate opening and closing of the ducts drawing the air stream through the portion of the collection screen separating the first removal duct from the inlet chamber and the portion of the collection screen separating the second removal duct from the inlet chamber; and (h) means for receiving cleaned cotton that falls from the collection screen and tumbles down the shaker screen and for removing the cleaned cotton from the housing.

9. The cotton cleaner of claim 8 wherein each damper means is a butterfly damper and includes (i) a common shaft means on which each damper means is mounted, said damper means being at right angles to each other;

(ii) a pneumatic cylinder;

(iii) crank arm means attached to the shaft and to the piston of the pneumatic cylinder whereby the outward stroke of the piston rotates the shaft a quarter turn thereby opening one outlet and closing the other and the inward stroke closes one outlet and opens the other.

10. The cotton cleaner of claim 9 wherein the means for receiving and removing cleaned cotton is a rotary means which discharges the cleaned cotton into a discharge pipe.

* * * * *